US005524403A

United States Patent [19]

Fullwood

[11] Patent Number: 5,524,403

[45] Date of Patent: Jun. 11, 1996

[54] STORM SHUTTER WINDOW FRAME SYSTEM

[75] Inventor: James Fullwood, Tequesta, Fla.

[73] Assignee: Duraframe Window Shutter Systems, Inc., West Palm Beach, Fla.

[21] Appl. No.: 504,411

[22] Filed: Jul. 20, 1995

Related U.S. Application Data

[62] Division of Ser. No. 328,197, Oct. 24, 1994, Pat. No. 5,465,537.

[51] Int. Cl.[6] ..... E06B 3/26

[52] U.S. Cl. ..... 52/202; 52/210; 52/656.7

[58] Field of Search ..... 52/202, 204.1, 52/204.5, 213, 215, 210, 208, 211, 212, 204.51, 656.5, 656.6, 656.2, 656.4, 656.7, 734.1, 734.2; 49/504, 505; 160/23.1, 31, 133, 26

[56] References Cited

U.S. PATENT DOCUMENTS

| | | | |
|---|---|---|---|
| 2,383,015 | 8/1945 | Pratt | 160/31 |
| 3,919,815 | 11/1975 | Alabaster | 52/240.1 X |
| 3,981,067 | 9/1976 | Oiler | 52/656.2 X |
| 3,983,674 | 10/1976 | Yamamoto et al. | 52/656.7 X |
| 4,640,054 | 2/1987 | Breimeier et al. | 49/504 |
| 4,922,661 | 5/1990 | Dallaire et al. | 49/504 |
| 5,072,547 | 12/1991 | DiFazio | 49/504 |
| 5,090,168 | 2/1992 | Fast et al. | 52/204.5 X |
| 5,099,624 | 3/1992 | Valentin | 52/204.5 X |
| 5,293,723 | 3/1994 | Slessor | 52/204.1 X |

FOREIGN PATENT DOCUMENTS

| | | | |
|---|---|---|---|
| 2276652 | 10/1994 | United Kingdom | 52/204.5 |

*Primary Examiner*—Lanna Mai

*Attorney, Agent, or Firm*—Morton J. Rosenberg; David I. Klein

[57] ABSTRACT

A building aperture frame system including a window mounting surface and an integrally-formed storm shutter mounting structure. The frame system may be comprised of first and second elongated profiled jambs, an elongated profiled header mounted to and traversing a distance between an upper portion of each of the first and second jambs, and an elongated profiled sill mounted to and traversing a distance between a bottom portion of each of the profiled jambs. Each of the profiled jambs, header and sill have a width sufficient to traverse at least a portion of a distance between an interior and an exterior surface of a building wall defining a building aperture. Alternatively, the building aperture frame system may be comprised of first and second profiled jambs capable of extending vertically along first and second vertical side walls of a building aperture. Each of the profiled jambs is capable of extending along a horizontal distance of at least a portion of the vertical side walls. The profiled jambs include a mounting surface for a window unit and an integrally-formed guide channel for a storm shutter.

16 Claims, 17 Drawing Sheets

STORM SHUTTER WINDOW FRAME SYSTEM

This is a divisional of application Ser. No. 08/328,197 filed on Oct. 24, 1994 now U.S.Pat. No. 5,465,537.

BACKGROUND OF THE INVENTION

A variety of systems are available to provide storm protection to openings on buildings that incorporate glass doors and windows. These protection systems range from crude plywood boards anchored to the surface of the building with nails, to electrically-operated, flexible steel shutters which can be rolled down from a storage position to cover window and door openings. Between these two extremes, there exists other types of shutter systems such as that which is disclosed in U.S. Pat. No. 4,685,261 to Seaquist.

With the exception of window protection systems that rely simply on plywood or some other material nailed to the exterior of a building construction, most storm shutters require the existence of previously-installed mounting structure to facilitate fast and efficient installation upon receiving warning of an oncoming storm. In the case of roll-down steel shutters, the entire shutter is rolled inside a horizontal casing attached permanently above a window or door. In addition, for roll-down steel shutters, guide tracks must be provided along the vertical portions of the window or doorway to guide the shutter as it is rolled up and down in front of a window or door to be protected. Other systems, such as that which is disclosed in U.S. Pat. No. 4,685,261 to Seaquist, require pre-installed mounting brackets to facilitate quick storm shutter installation in the event of a storm warning.

One significant problem concerning storm shutters is the manner in which they are installed. Since these storm protection systems are typically not part of the original design for the building on which they are installed, the methods employed for securing them to a building are not always sufficient to withstand very high wind speeds or impact from flying debris. This is a significant problem, particularly when unskilled laborers or inexperienced homeowners are installing these storm protection devices.

Even in those instances where storm shutter systems are properly installed, they may be prone to failure as a consequence of the location in which they are mounted. Specifically, since many shutter systems are installed on the outer surface of a construction, rather than within a window or door casing, they suffer from a common problem which relates to their vulnerability to being ripped out of their mounting by wind and debris. Shutter mounting structures, which are located on the outer surface of the building rather than in a window or door casing, are prone to experience greater stress from high winds. Substructures are also vulnerable to debris impacting upon such mounting structure, as flying debris is common in hurricane-strength storms.

The present invention is designed to alleviate the problems found in shutter mounting systems of the prior art, and to provide a window frame system capable of securely maintaining a storm shutter in position without detracting from the aesthetics of a house or building. The invention is also designed to provide an inexpensive shutter mounting system which can be easily and economically incorporated into the design of a building construction.

SUMMARY OF THE INVENTION

The apparatus according to the present invention is a building aperture frame system designed to be fitted in window casings or other openings of buildings wherein storm shutters may need to be installed. The invention is comprised of first and second profiled jambs which are capable of extending along first and second vertical side walls defining a building window opening. The cross-section of each jamb, as considered from the interior side of the building aperture to the exterior side of the building aperture, is comprised of at least a mounting surface for a window unit and a spaced, integrally-formed guide for a storm shutter. An interior spacer, an intermediate spacer between the mounting surface and the guide channel, and an exterior lip for receiving a building siding material may also be provided. Significantly, the interior spacer, the mounting surface, the guide channel, the intermediate spacer and the exterior lip are integrally formed as part of a single unit comprising the profiled jambs.

In addition, the invention can include a profiled header and sill capable of traversing the distance between an upper and lower portion of the first and second profiled jambs respectively. The header, the sill and the jambs are all designed such that they may be mounted to a window or door opening in a building under construction. Similar to the jambs, the sill may be integrally formed of a sill interior spacer, a sill mounting surface for a window unit, a sill guide channel for a storm shutter, a sill intermediate spacer, and a sill exterior lip for receiving a building siding material. The header may be formed in a similar manner or, depending upon the storm shutter system to be used, may be formed as a housing for a roll-up type storm shutter.

DETAILED DESCRIPTION OF THE INVENTION

Figure 1:
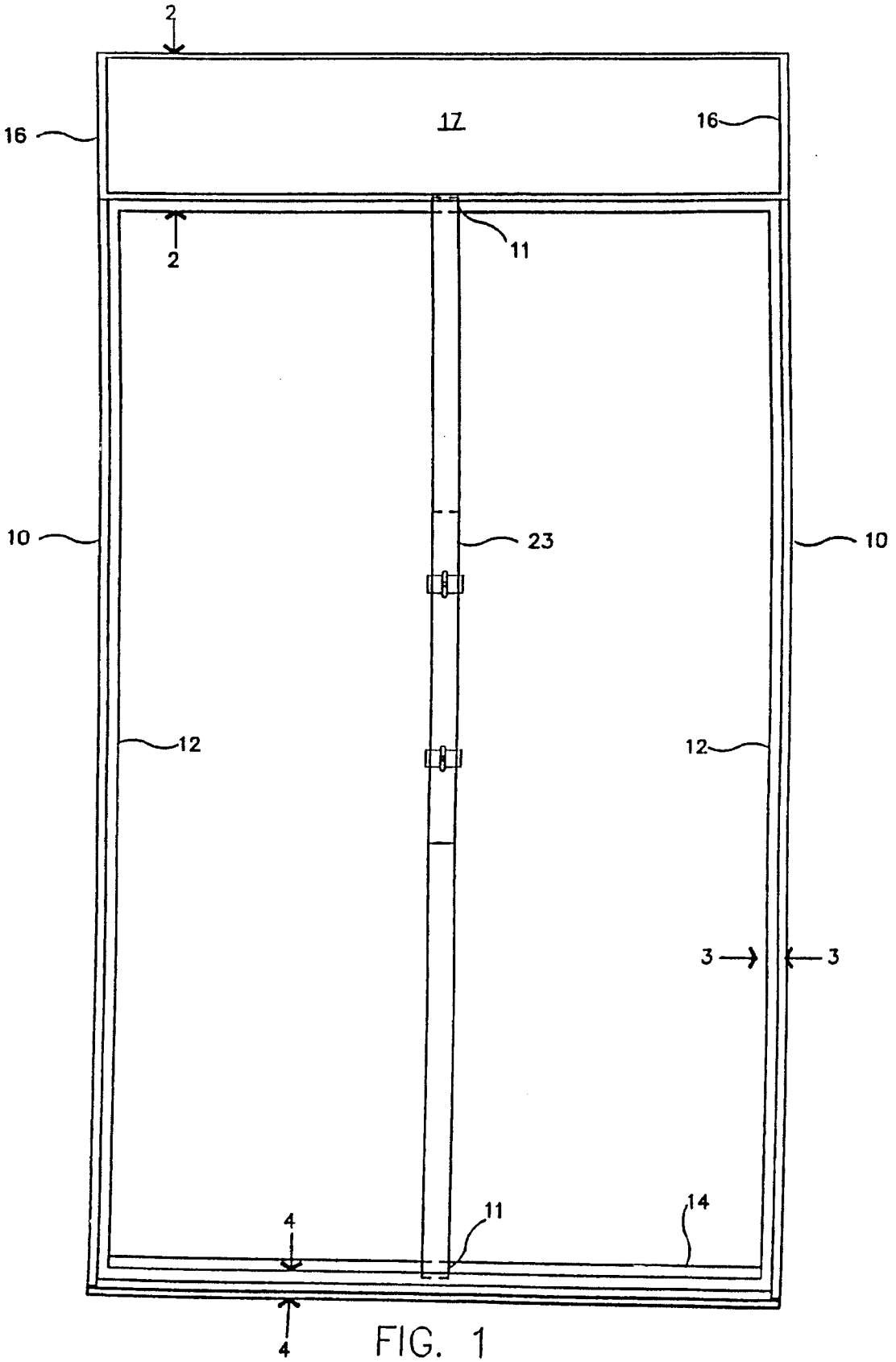
FIG. 1 is an elevation view of a first embodiment of a building aperture frame system according to the present invention, with a lock bar in place.

This invention relates to a window frame system for buildings and, in particular, relates to a window frame system capable of accommodating a storm shutter. As shown in FIGS. 1–5 the system according to a first embodiment is comprised of an outer frame 10 which can be formed from profiled jambs 12, a profiled sill 14 and a shutter housing 16. Profiled jambs 12 and profiled sill 14 are preferably mitred at the corners where they meet to form part of a rectangular frame as shown in FIG. 1. Shutter housing 16 is mounted to profiled jambs 12 at their upper ends.

The particular configuration of profiled jambs 12 and sill 14 shown in FIGS. 1–5 are designed for use with an 8" thick, concrete block wall. Significantly, however, the invention is not so limited, and other configurations are possible.

Figure 3:
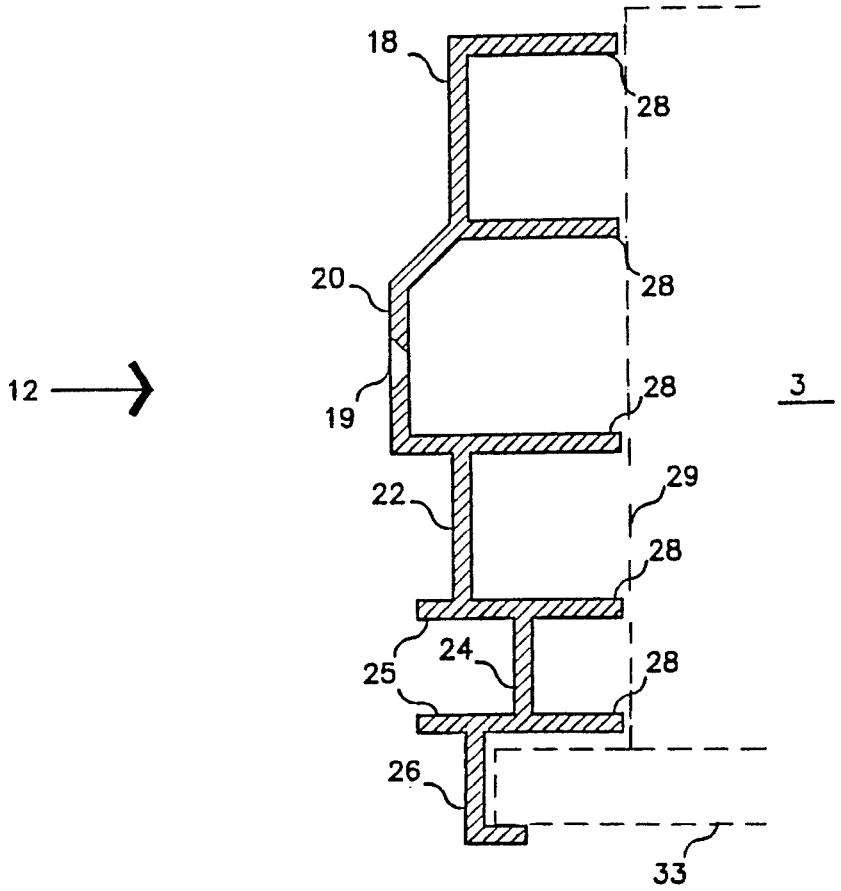
FIG. 3 is a cross-sectional view along lines 3—3 in FIG. 1.

As shown in FIG. 3, jambs 12 are preferably formed from an extruded material and have a profiled cross-section. One jamb 12 will have the orientation shown in FIG. 3 while the other jamb will have the reverse configuration to accommodate its placement on the opposite side of the frame system.

The profiled jamb 12 is comprised of several distinct portions, each performing a specific function. In particular, the jamb preferably includes an interior spacer 18, a window mounting surface 20, an intermediate spacer 22, a guide channel 24 and an exterior lip 26. Various other jamb configurations are possible. However, the jamb should at least provide an integrally formed window mounting surface 20 and an integrally formed guide channel 24. In a preferred embodiment, the window mounting surface 20 is slightly less than the thickness of a window unit to be mounted in the frame system. Mounting bolt apertures 19 can be provided to facilitate securing the jamb 12 to a window casing.

The guide channel 24, according to the present invention, is preferably formed from a U-shaped portion of profiled jamb 12 defined by two guide walls 25. Exterior lip 26 is comprised of an extension plate projecting outwardly from the guide channel 24, in a direction substantially perpendicular to guide wall 25. A flange portion of said exterior lip 26 projects outwardly from said extension plate away from the building aperture. Intermediate spacer 22 is preferably formed to provide clearance between components comprising a window unit and a shutter plane, defined by guide channels 24.

On the rear surface of the jamb 12 are provided support legs 28. Jamb 12 is designed to be mounted such that support legs 28 engage the surface of a building aperture along a vertical side wall surface 29 of wall 3 of said aperture. For the purpose of this description, the vertical side wall surface 29 is understood to mean the portion of the building wall 3 traversing the distance between the interior and exterior surfaces of the wall 3 along a vertical portion of the building aperture.

Figure 4:
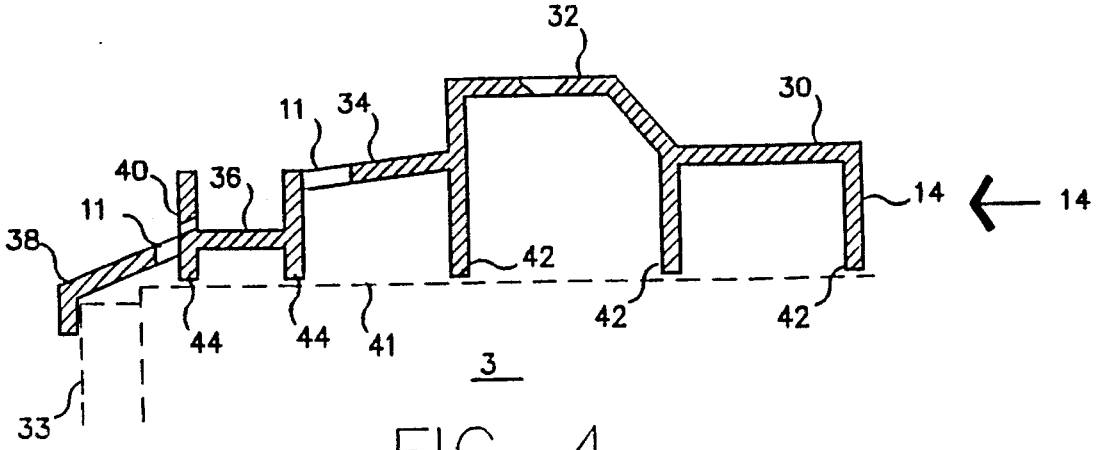
FIG. 4 is a cross-sectional view along lines 4—4 in FIG. 1.

As shown in FIG. 4, the profiled sill 14 is similar to profiled jamb 12 in that it preferably incorporates a sill interior spacer 30, a sill mounting surface 32, a sill intermediate spacer 34, a sill guide channel 36 and a sill exterior lip 38. As noted above, however, the precise configuration of the profiled sill can vary substantially, so long as a window mounting surface is provided, as well as a spaced sill guide channel. A weep hole 40 can be provided at the base of sill guide channel 36 to allow accumulated water to drain.

The sill exterior lip 38 is preferably comprised of a downwardly-angled drip plate extending outwardly from said building aperture along a lower portion of the sill guide channel 36. The exterior lip 38 can be further comprised of a flange portion extending downwardly away from the drip plate. When formed in this manner, the sill exterior lip is adapted to receive a building siding material 33 in the channel formed by the angled drip plate and the flange portion.

Sill support legs 42 and support nubs 44 are provided on the rear surface of the profiled sill for engaging a sill support wall surface 41 traversing the distance between the interior and exterior portions of a window aperture along its base. Profiled jambs 12 and profiled sill 14, are preferably designed such that the interior spacer, mounting surface, intermediate spacer and guide channel of each unit align with one another when the frame system is constructed and installed.

Figure 2:
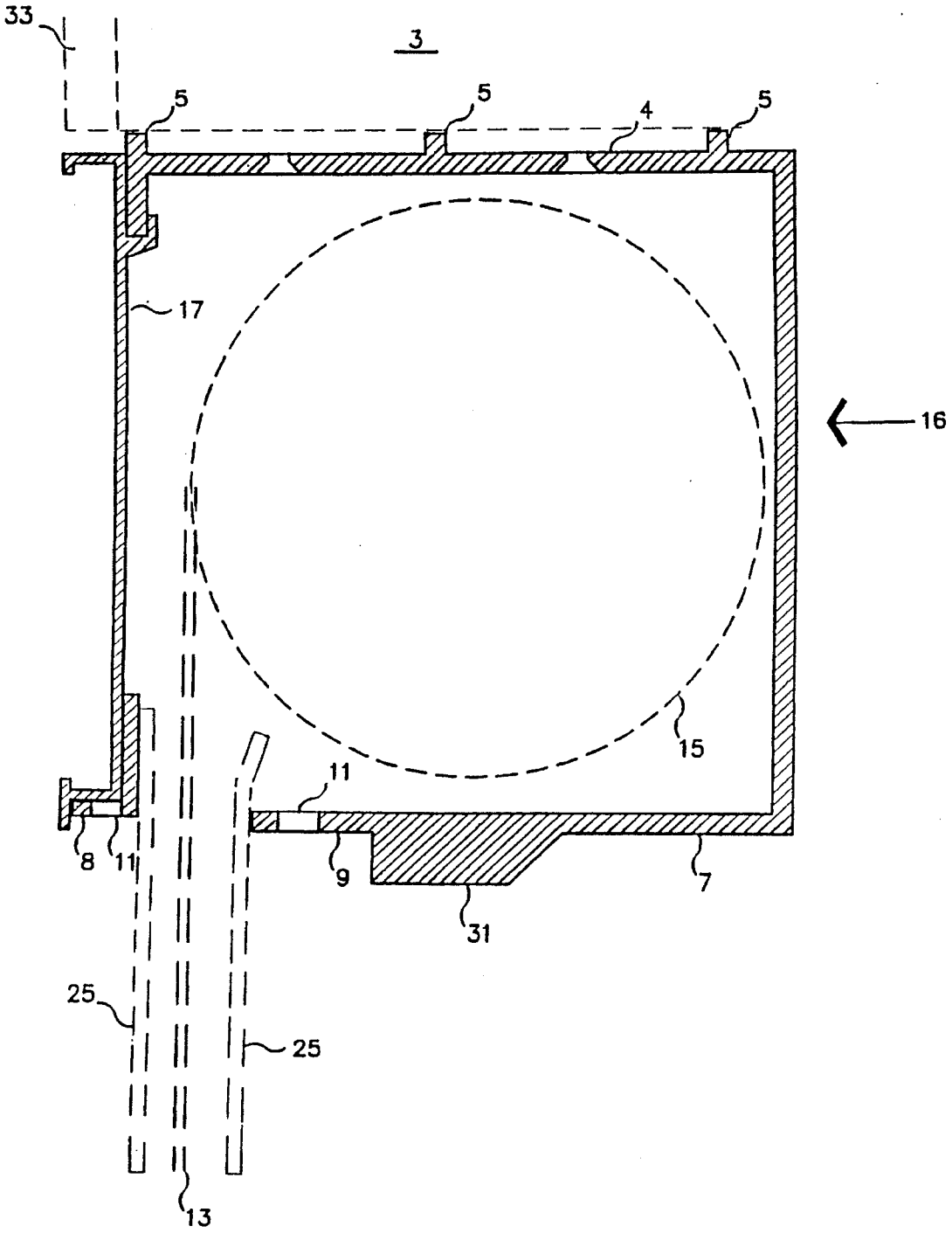
FIG. 2 is a cross-sectional view along lines 2—2 in FIG. 1.

As shown in FIG. 2, when a roll shutter 15 encased within shutter housing 16 is manually or automatically deployed, leading edge 13 of roll shutter 15 can be guided downwardly along jamb guide walls 25 forming guide channels 24 in jambs 12. When completely extended, roll shutter leading edge 13 will preferably engage sill guide channel 36 and can thereafter be locked in that position. Shutter housing 16 is mounted between an upper portion of jambs 12, such that a shutter deployment slot 21 is aligned with jamb guide channels 24. Shutter housing 16 is preferably provided with a removable front panel 17 to permit access to a roll shutter unit within the housing. Removable front panel 17 can be formed with a U-shaped profile for receiving a trim piece, which is preferably chosen to match the exterior siding applied to building wall 3. In addition, a housing window mounting surface 31 can be provided to facilitate mounting of a window unit within the frame system. The housing 16 also includes a housing intermediate spacer 9, a housing frame stiffener 8, and an interior spacer 7. Finally, support nubs 5 are formed on an upper surface 4 of housing 16 for engaging building wall 3.

As shown in FIG. 1, profiled sill 14 and housing 16 can be provided with lock bar apertures 11 formed in intermediate spacers 9, 34 at selected locations along the respective lengths of the sill and housing. Lock bar apertures 11 are designed for receiving an adjustable length lock bar 23 for supporting a rear surface of a storm shutter to prevent it from collapsing toward the interior space of a building construction. In addition, lock bar apertures 11 can be provided along exterior lip 38 and frame stiffener 8 for receiving additional lock bars on the outer surface of storm shutters.

According to the present invention, the frame system shown in FIGS. 1–5 can be mounted in a window or doorway aperture by any appropriate means such as bolts or screws passing through the jambs 12, sill 14 and housing 16. Once mounted in this position, the frame system provides a window unit mounting surface 20, 31, 32. More importantly however, the frame system also provides an integrally formed roll up shutter guide system having superior strength characteristics as compared to shutter guide systems of the prior art.

The superior strength characteristics of the present frame system results from several factors. One important factor stems from the additional structural support provided to the shutter guide by the window or glass door unit itself. A window or glass door unit as referred to herein includes an independent frame for supporting glass panels. Thus, a window or glass door unit mounted within the shutter frame, according to the present invention, internally braces the frame system, including the integrally formed shutter guides. In addition, the wider mounting surface defined by the profiled jambs 12, profiled sill 14, and housing 16 provide a larger area for locating mounting bolts than would typically be possible for a separately mounted shutter guide. This permits stronger mounting and a more stable base.

A further strength advantage of the present invention stems from the relatively close spacing obtained between the window unit mounting surface and a plane defined by the shutter mounting structure. The close spacing allows the window unit itself to provide storm shutters with additional support when impacted by a flying projectile. As a result of this design, a shutter which is impacted by a projectile will have a decreased ability to flex inwardly, which flexing might otherwise result in said shutter being torn from its guide tracks. This is an important feature because, once dislodged from its guide tracks, a shutter can easily be torn away from a building structure by high winds. In the present invention, flexing is still further reduced by the addition of the lock bars which can be placed on opposing sides of an installed shutter.

Finally, utilizing a frame system according to the present invention simplifies building construction and results in an improved appearance. Construction is simplified because a builder can avoid the additional step of installing and aligning independent shutter guide channels. As described below, however, appearance is also improved since the shutter guides can be more smoothly integrated with the outer siding of a building which is being constructed.

In a preferred embodiment, the frame system according to the present invention can be installed in a building aperture such that jamb support leg 28, mounted to the edge of interior spacer 18, is aligned flush or slightly offset from the interior surface of an unfinished building wall 3. See FIG. 4. Support leg 28 adjacent to exterior lip 26 is preferably aligned with, or set slightly back from, the exterior surface of a building wall 3 of the building under construction. When mounted in this manner, exterior lip 26 of jamb 12 provides a pocket into which a siding material 33, such as cement or plaster, may be filled so that the exterior surface of siding 33 can be aligned with, or recessed slightly behind, the exterior edge of the jamb as shown.

As shown in FIG. 4, profiled sill 14 is preferably mounted in a similar manner to jamb 12 so that support leg 42 on the innermost side of sill interior spacer 30 is approximately aligned with or slightly offset from the interior surface of the wall under construction. Like the jamb, when the sill is installed in this manner, the exterior lip 38 will protrude slightly beyond the surface of an unfinished concrete block wall. Here again, the sill exterior lip is provided such that when an exterior cement or plaster siding material 3 is applied to the concrete wall, the exterior finish will fill in the area of the sill lip, so that it is slightly recessed behind the edge of the sill.

Figure 5:
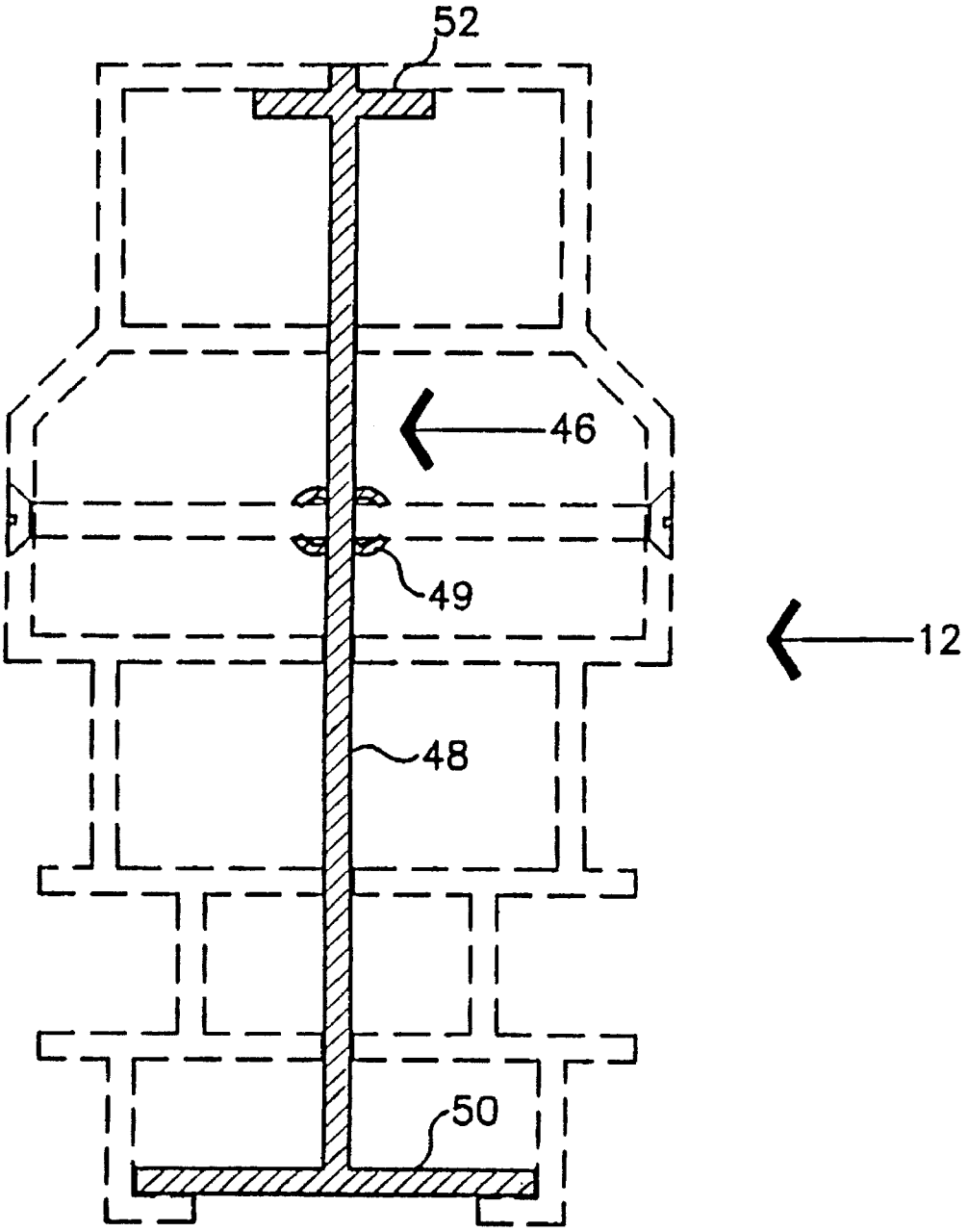
FIG. 5 is a cross-sectional view of a tee mullion for mounting a plurality of the frame systems shown in FIG. 1, side by side.

FIG. 5 shows a tee mullion 46 for use in aligning and supporting, side by side, a plurality of aperture frame systems of the type shown in FIG. 1. Tee mullion 46 is comprised of a primary member 48, main cross-member 50 and secondary cross-member 52. When it is desired to mount window frames according to the present invention adjacent to one another, support legs 28 of adjacent jambs 12 will engage the surface of primary member 48. Screw receptacles 49 are provided for receiving a mounting screw passing through said jambs. Main cross-member 50 serves to support the exterior lip 26 portions of the jambs 12 and also fills in the space which would normally be filled by an exterior siding such as cement or plaster. Secondary cross-member 52 is provided to help maintain adjacent jambs 12 in proper position with respect to one another.

A second embodiment according to the present invention is shown in FIGS. 6–10. In this embodiment, the frame system is not designed for operation with a roll up shutter. Instead, an integrated mounting system is provided for storm shutters which may be physically placed in the window frame upon warning of an approaching storm. As with the previous embodiment, the profiled parts of the frame system in FIGS. 6–10 are designed for an 8" thick concrete block wall. However, the invention again is not limited in this regard, and various other configurations are possible.

Figure 6:
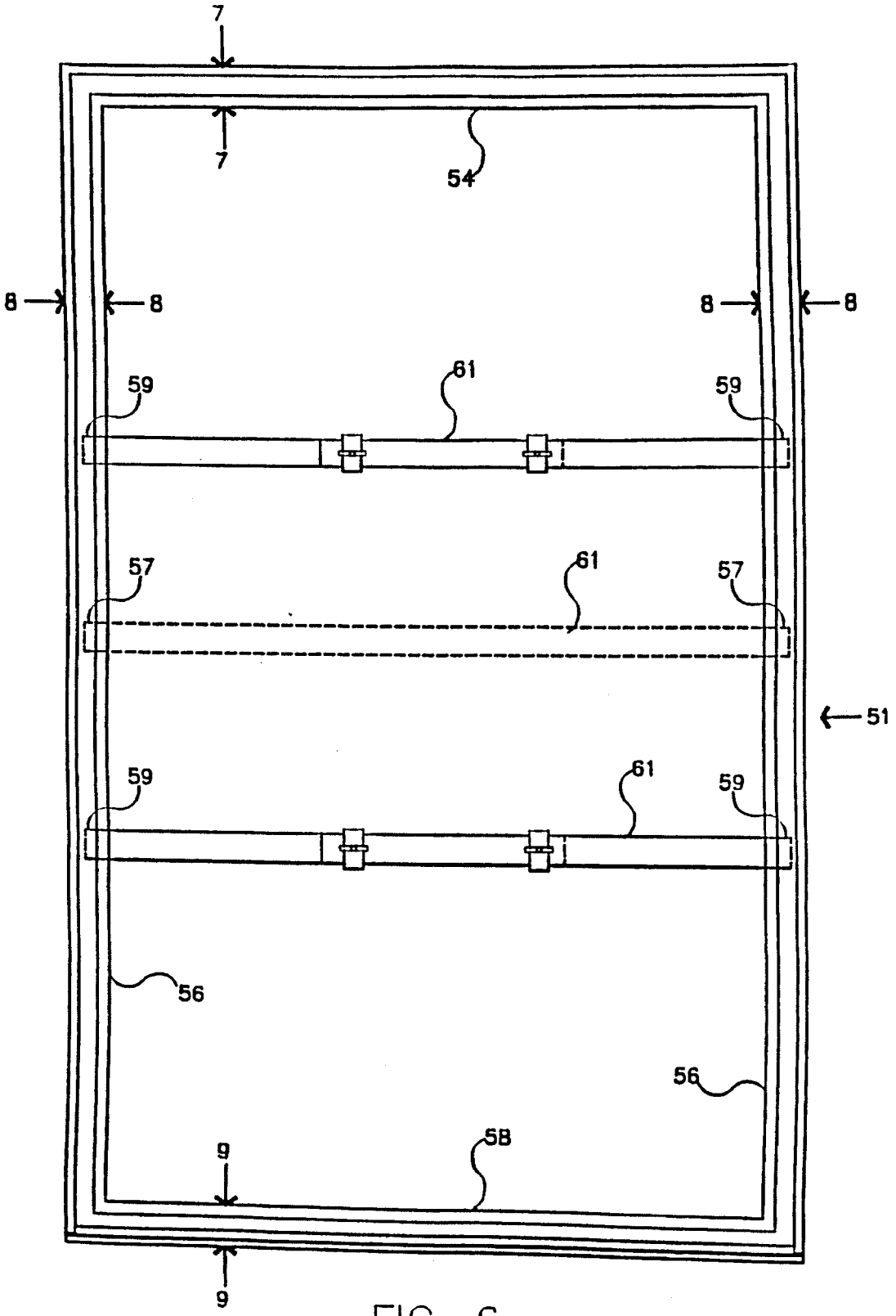
FIG. 6 is an elevation view of a second embodiment of a frame system according to the present invention, with lock bars in place.

As shown in FIG. 6, the window frame is comprised of a profiled head 54, profiled jambs 56 and a profiled sill 58. Sill 58, jambs 56 and head 54 are preferably mitred at their ends to form a continuous outer frame 51.

Figure 7:
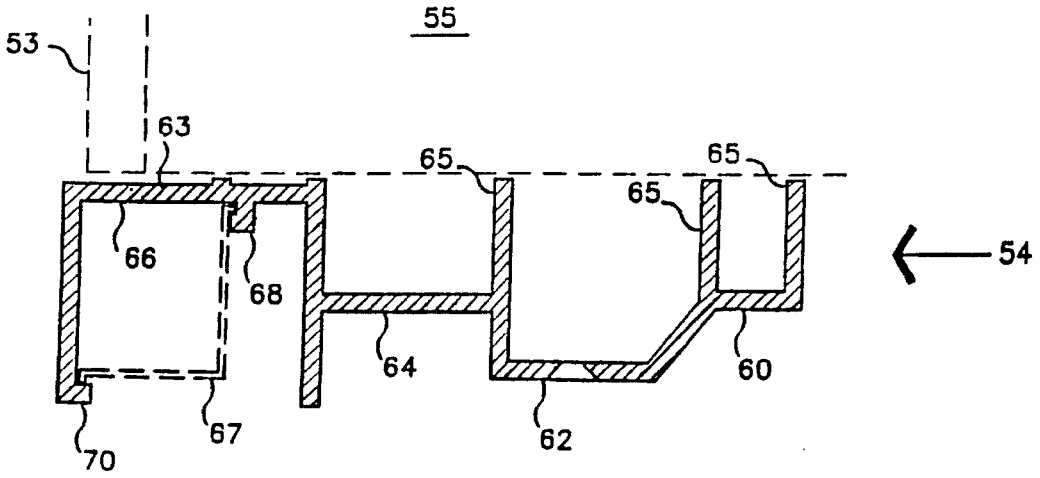
FIG. 7 is a cross-sectional view along line 7—7 in FIG. 6.

FIG. 7 shows a cross-sectional view of profiled head 54. Profiled head 54 can be comprised of an interior spacer 60, a mounting surface 62, an intermediate spacer 64 and a guide channel 66. Guide channel 66 is preferably provided with locking tabs 68 and 70.

Head locking tabs 68 and 70 are provided for receiving a spring clip 67 as shown in FIG. 7. The purpose of clip 67 is to decrease the width of head guide channel 66 in cases where the material from which the storm shutters is formed has a thickness of less than the entire guide channel 66. In effect, spring clip 67 is a removable spacer mechanism.

On the rear surface of the profiled head 54, support legs 65 are provided to engage the upper portion of a building wall 55 traversing the distance between the interior and exterior surfaces of a building wall through the aperture. Finally, an exterior lip 63 is defined on a portion of said header defining a rear surface of said guide channel base.

Figure 8:
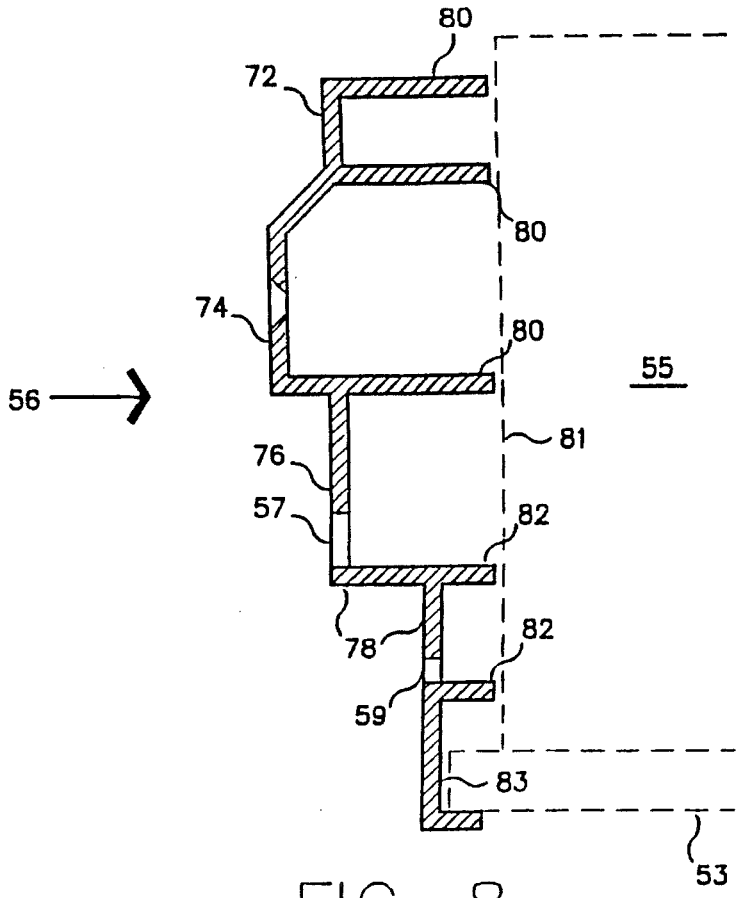
FIG. 8 is a cross-sectional view along line 8—8 in FIG. 6.

FIG. 8 shows a cross-sectional view of profiled jamb 56. Similar to profiled head 54, profiled jamb 56 can incorporate a jamb interior spacer 72, a jamb mounting surface 74, a jamb intermediate spacer 76 and an L-shaped mounting brace 78 for receiving a storm shutter. Support legs 80 and support nubs 82 are also provided. The jamb 56 located on the opposite side of the frame system will have the reverse orientation of the frame shown in FIG. 8 to accommodate its placement. Jambs 56 are designed to be mounted such that the support legs 80 and support nubs 82 engage the surface of a vertical side wall 81 of a building wall 55 traversing the distance between the interior and exterior surfaces of the building wall. Exterior lip 83 is provided to extend the jamb slightly beyond the surface of an unsided building wall 55.

Figure 9:
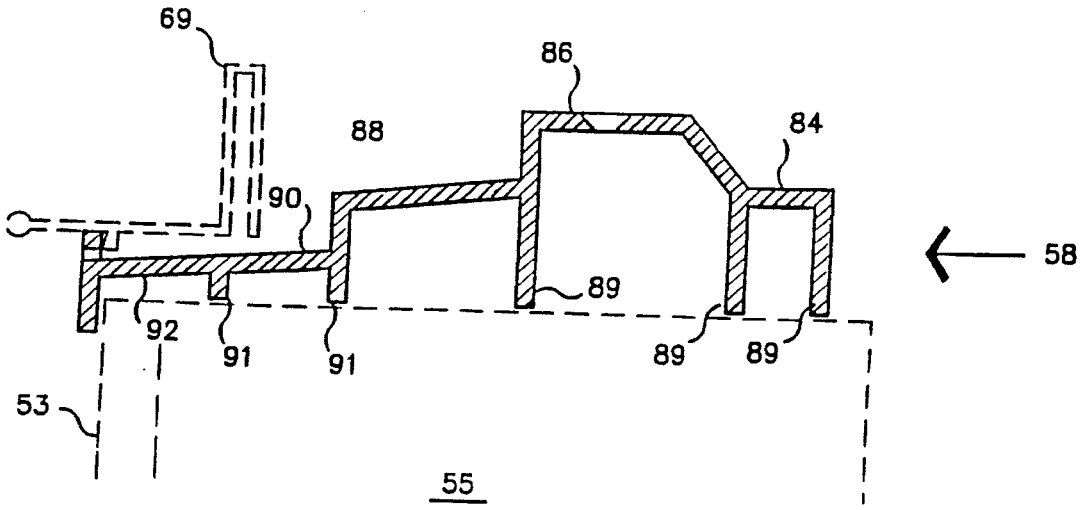
FIG. 9 is a cross-sectional view along line 9—9 in FIG. 6.

FIG. 9 shows the profiled sill 58 of outer frame 51 in cross-section. The profiled sill 58 is preferably comprised of a sill interior spacer 84, a sill mounting surface 86, a sill intermediate spacer 88 and a shutter mount channel 90. A sill exterior lip 92 is provided to extend the sill slightly beyond the surface of an unfinished building wall 55. Support legs 89 and support hubs 91 are also provided as shown. A spring clip 69 can be provided as a spacer mechanism to aid in the positioning of shutters having decreased thickness.

The profiled head 54, profiled jambs 56 and profiled sill 58 are preferably designed such that the interior spacer 60, 72, 84, mounting surface 62, 74, 86, and intermediate spacer 64, 76, 88 of each of these components align with one another when the frame system is assembled. As previously explained, the precise configuration of the profiled jambs, sill and header can be varied so long as a window mounting surface is provided spaced apart from an integrally formed storm shutter mounting structure.

The frame system is preferably installed such that the edge of interior spacer 60, 72 and 84 is aligned with or slightly offset from the interior surface of an unfinished building wall 55. When mounted in this fashion, the profiled head 54, jambs 56 and sill 58 will protrude slightly beyond the unfinished exterior surface of the wall 55. Thus, as with the previously described embodiments, the window frame provides an exterior lip 63, 83, 92 into which may be filled an exterior siding material 53, such as cement or plaster. See FIGS. 7–9. When a siding is applied in this manner, the siding material exterior surface will be preferably applied such that it is slightly recessed behind the outer edge exterior lip 63, 83, 92 as shown in FIGS. 7–9. Mounting holes can be provided in said profiled head 54, jambs 56 and sill 58 to accommodate mounting bolts for engaging wall 55.

When installed as described above and bolted in place, the frame system according to the present invention provides a convenient and strong mounting system for removable storm shutters. Specifically, a storm shutter manufactured from corrugated steel or plywood can be provided to approximately fit the outline defined by the head guide channel 66, the jamb mounting braces 78 and the sill mounting channel 90. The panel is preferably sized so that it may be inserted in head guide channel 66 with sufficient clearance to pass over an upper portion of sill exterior lip 92 and thereafter be downwardly displaced to rest in sill mounting channel 90. As shown in FIG. 7 and 9, spring clip spacers 67, 69 may be used for thinner types of shutter material.

As shown in FIG. 6, jambs 56 can be provided with lock bar apertures 57 formed in intermediate spacers 76 at selected locations along the vertical height of the jambs. Lock bar apertures 57 are designed to receive an adjustable length lock bar 61. Adjustable length lock bars 61 provide support to a rear surface of a storm shutter to prevent it from collapsing inwardly toward the interior space of a building construction. In addition, lock bar apertures 59 can be provided along L-shaped mounting brace 78 for receiving additional lock bars 61 on the outer service of storm shutters after they have been positioned within the frame system.

According to the present invention, the frame system shown in FIGS. 6–11 can be mounted in a window opening by any suitable means such as bolts or screws. Mounting holes are preferably provided in the head 54, jamb 56 and sill 58 to facilitate this result. Once mounted in this position, the frame system provides a window mounting surface 74, 62, 86. More importantly, however, the frame system also provides an integrated mounting location for storm shutters, which mounting system has superior strength characteristics as compared to mounting systems of the prior art.

The superior strength characteristics of the present frame system result from essentially the same factors as discussed with regard to the previous embodiment. One such factor stems from the additional structural support provided to the shutter guide by the window or glass door unit installed within the frame system. A window or door unit, according to the present invention, has an independent frame system for positioning a glass pane. The independent frame mounted within the frame system of the present invention internally braces the frame system, and therefore provides additional structural support to the integrally formed shutter mounting structure. In addition, the wider mounting surface defined by the profiled jambs 56, profiled head 54 and profiled sill 58 provide a larger area for locating mounting bolts as compared to that which would typically be available for a storm shutter mounting system which was not incorporated into the present frame system.

Finally, utilizing a frame system as described in the present embodiment simplifies building construction in the same manner as described in the previous embodiment. Construction is simplified because a builder can avoid the additional steps of installing and aligning independent shutter mounting hardware. Appearance is also improved since there is no need for installation of an additional shutter mounting structure.

Figure 10:
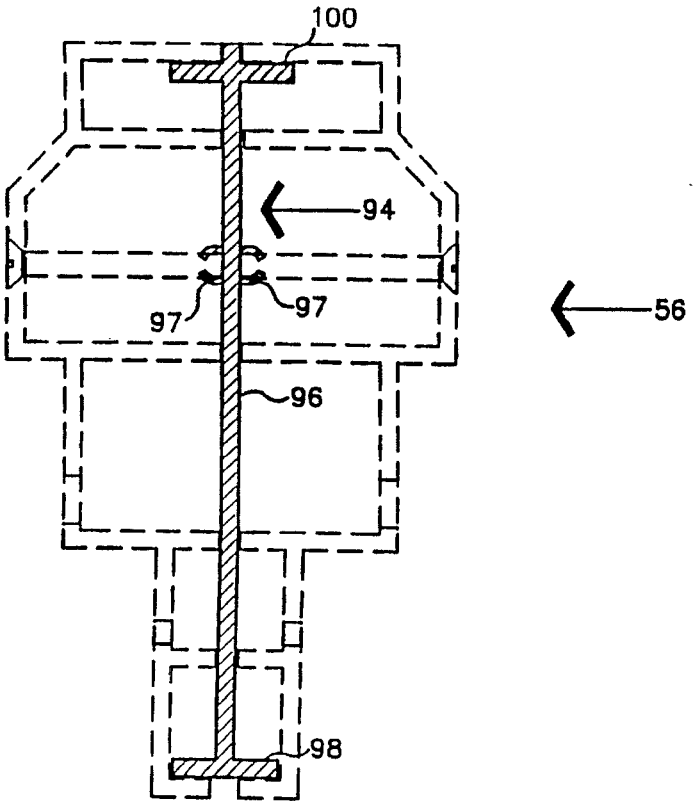
FIG. 10 is a cross-sectional view of a tee mullion for mounting a plurality of the frames shown in FIG. 6, side by side.

FIG. 10 shows a tee mullion 94 for use in aligning and supporting, side by side, a plurality of aperture frame systems of the type shown in FIG. 6. Tee mullion 94 is comprised of a primary member 96, a main cross-member 98 and a secondary cross-member 100. When it is desired to mount window frames according to the present embodiment adjacent to one another, support legs 80 and support hubs 82 of adjacent profiled jambs 56 will engage the surface of primary member 96 as shown in FIG. 10. Screw receptacles 97 are provided to receive mounting screws passing through the profiled jambs 56. Main cross-member 98 serves to support the outermost portion of the L-shaped mounting brace 78 and also fills in the space which would normally be filled by an exterior siding such as cement or plaster. Secondary cross-member 100 is provided to help maintain adjacent jambs 56 in position with respect to one another.

The third and fourth embodiments of the present invention shown in FIGS. 11–15 and 16–20 are generally similar to the embodiments shown in FIGS. 6–10. The embodiment in FIGS. 11–15 is designed to preferably be used with a 6" stud wall, and the embodiment in FIGS. 16–20 is designed to preferably be used with a 4" stud wall. However, the invention is not so limited. Corresponding components of each of these embodiments have been referenced using the same numbers as in FIGS. 6–10, with the suffix a and b added, respectively.

Figure 11:
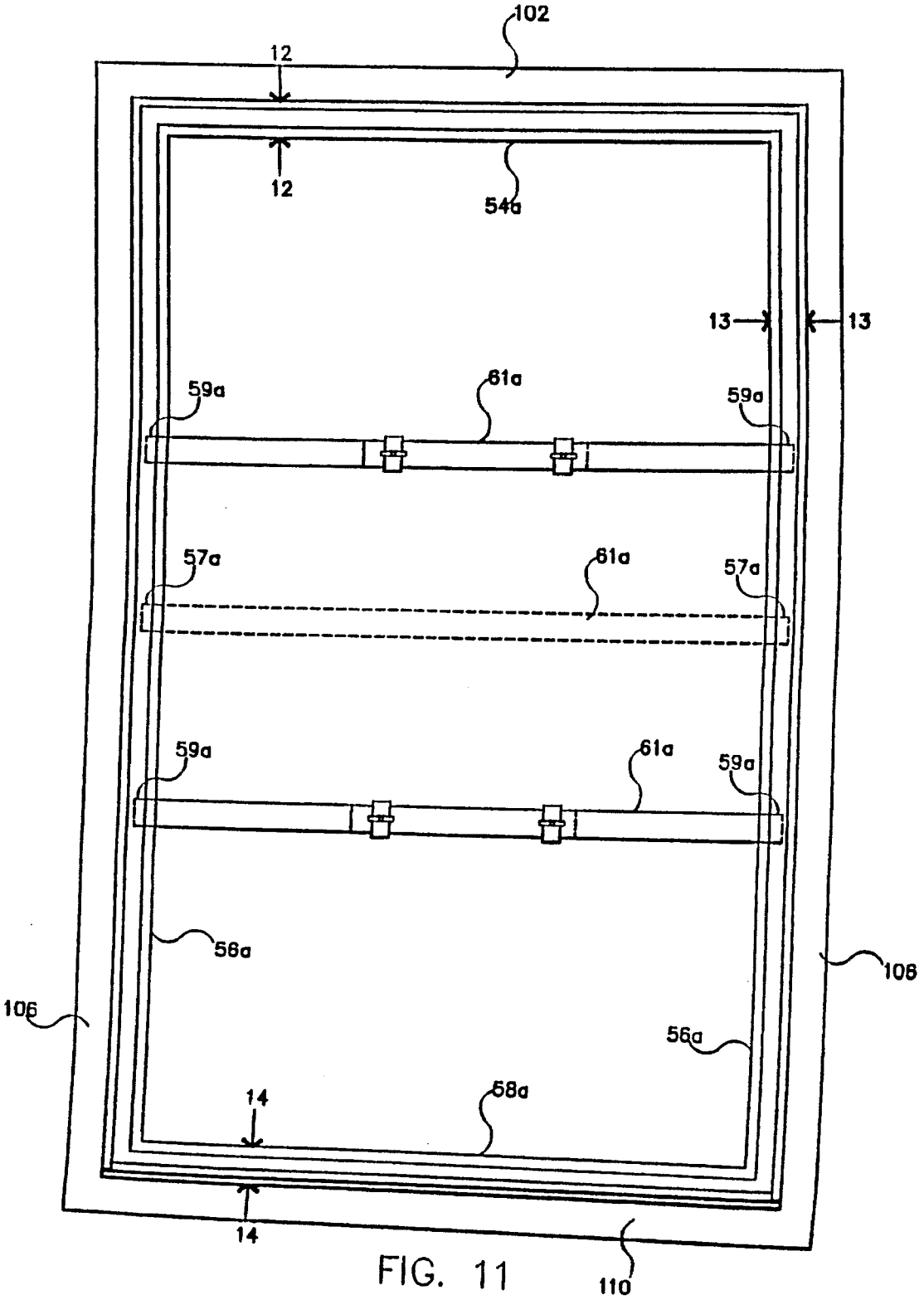
FIG. 11 is an elevation view of a window frame system according to a third embodiment of the present invention.
Figure 13:
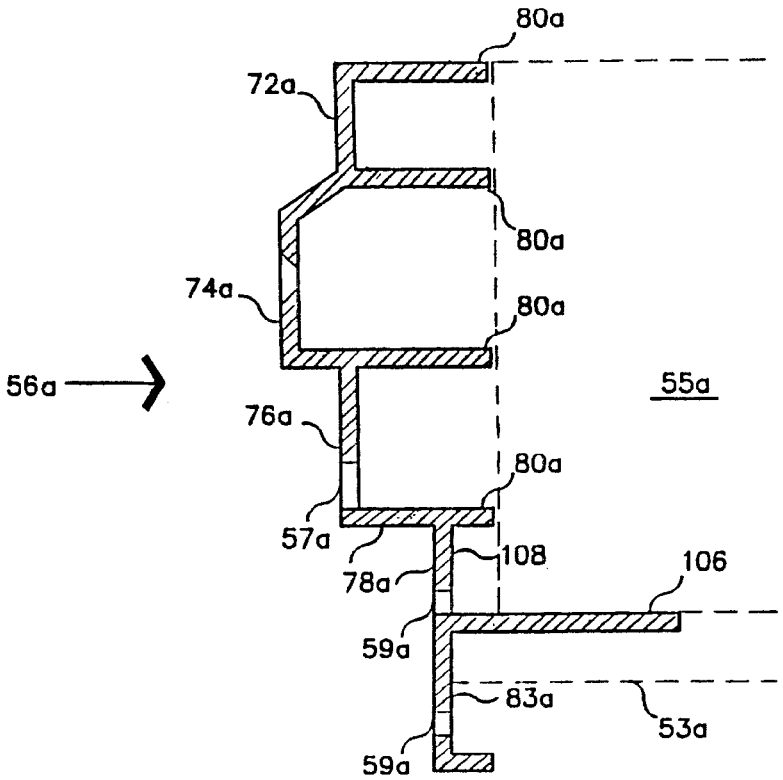
FIG. 13 is a cross-sectional view along lines 13—13 in FIG. 11.
Figure 12:
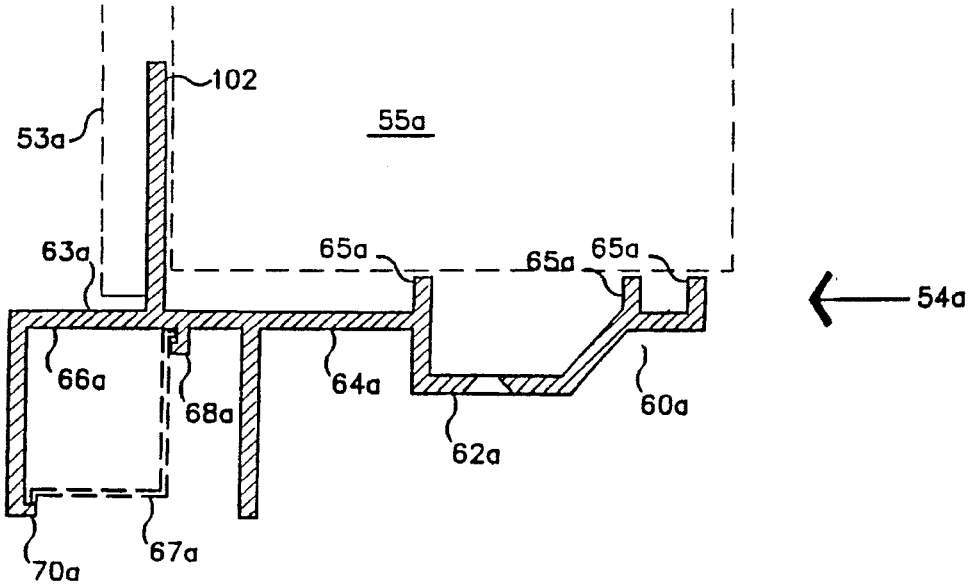
FIG. 12 is a cross-sectional view along lines 12—12 in FIG. 11.
Figure 14:
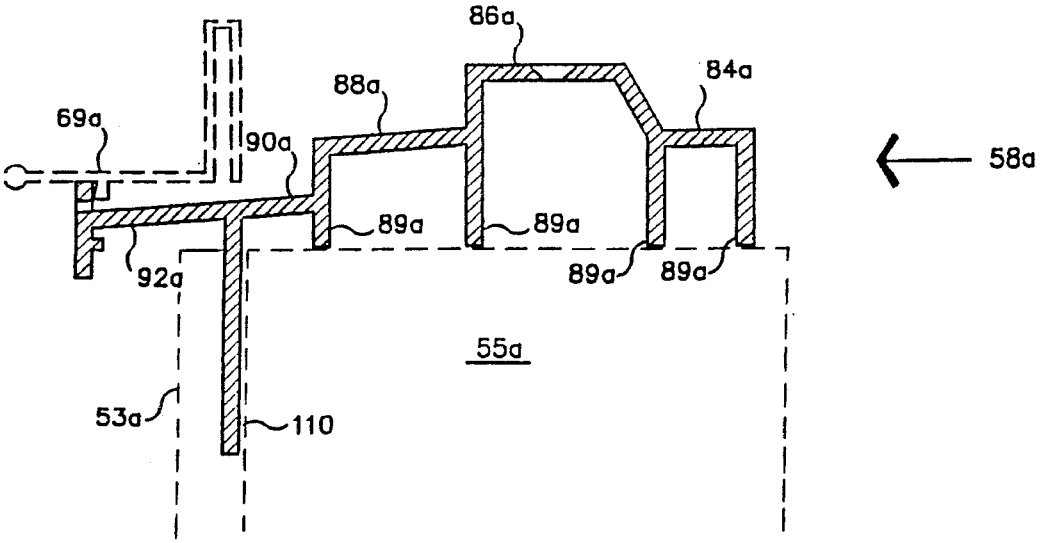
FIG. 14 is a cross-sectional view along lines 14—14 in FIG. 11.

As noted above, the building aperture frame system shown in FIGS. 11–15 is preferably used in connection with a 6" stud wall. To accommodate the decreased wall thickness, the profiled head **54*a*, profiled jamb 56*a* and profiled sill 58*a* are formed with a slightly different configuration as compared to the embodiments shown in FIGS. 6–10. Most significantly, exterior surface plates 102, 106, 110 in FIGS. 12–14 are provided on profiled head 54*a*, profiled jamb 56*a*** and profiled sill 58*a*, respectively, for positioning the frame system in the building aperture. When placed along the exterior wall surface of a building aperture wherein 6" stud wall construction is used, exterior surface plates 102, 106, 110 will engage the unfinished exterior surface of a wall 55*a*. This will position the frame system such that interior-most support leg 65*a*, 80*a*, 89*a* will be positioned adjacent to or slightly offset from the unfinished interior surface of the wall 55*a* surrounding the aperture.

As with the previous embodiment, head locking tabs 68*a* and 70*a* in FIG. 12 are provided in channel 66*a*. The purpose of said tabs is for receiving a spring clip 67*a* in the event that head guide channel 66*a* is too wide to receive the particular type of material from which a storm shutter is formed. Here again, spring clip 67*a* essentially acts as a removable spacer mechanism for storm shutters of lesser thickness. Similarly, spring clips 69*a* can be provided for use with sill 58*a* in FIG. 14.

After the frame system is installed, a siding material 53*a* is preferably applied on the exterior surface of the building wall 55*a* surrounding the frame system. The siding material 53*a* is preferably applied so as to fill in the area around exterior lip surfaces 63*a*, 83*a*, 92*a*, 108, 112. In this manner, the exterior siding material 53*a* will appear to be slightly recessed behind the outermost edge of the frame system.

As with the previously described embodiments, the frame system according to the embodiment shown in FIGS. 11–15 should be constructed such that the various interior spacers 60*a*, 72*a* and 84*a*, mounting surfaces 62*a*, 74*a* and 86*a*, intermediate spacers 64*a*, 76*a* and 88*a* are, respectively, in alignment with one another. Likewise, head guide channel 66*a* should be substantially in alignment with L-shape mounting brace 78*a* and sill mounting channel 90*a* for receiving a storm shutter.

Figure 15:
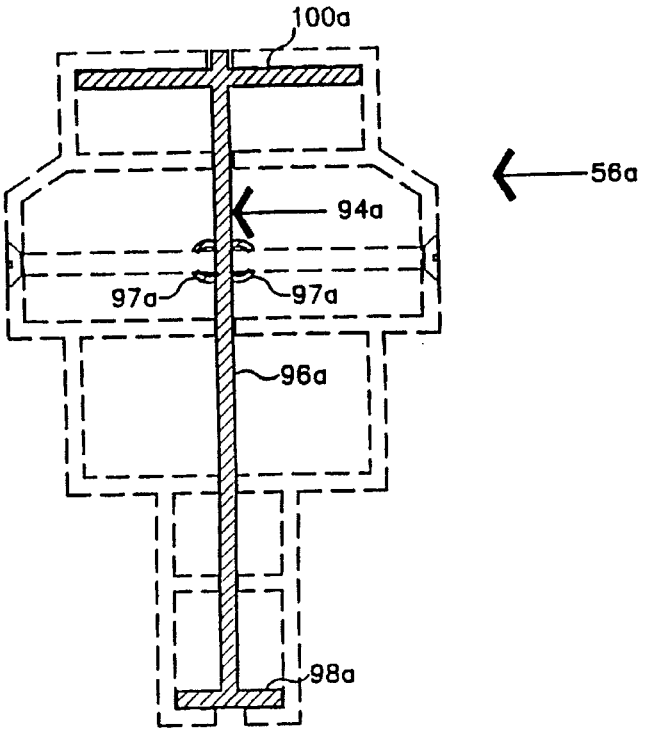
FIG. 15 is a cross-sectional view of a tee mullion for mounting a plurality of the frame systems shown in FIG. 11, side by side.

FIG. 15 shows a tee mullion 94*a* to facilitate mounting a plurality of frame systems according to the present embodiment adjacent to one another in a building aperture. Similar to the previous embodiments, tee mullion 94*a* is comprised of a primary member 96*a*, a main cross-member 98*a*, secondary cross-member 100*a* and screw receptacles 97*a*. Finally, as shown in FIG. 11 and 13, apertures 57*a* and 59*a* can be provided respectively in the interior spacer 76*a* and along L-shaped mounting brace 78*a* for receiving adjustable length lock bars 61. The lock bars brace the interior and exterior surface of a storm shutter installed in the frame system.

Figure 16:
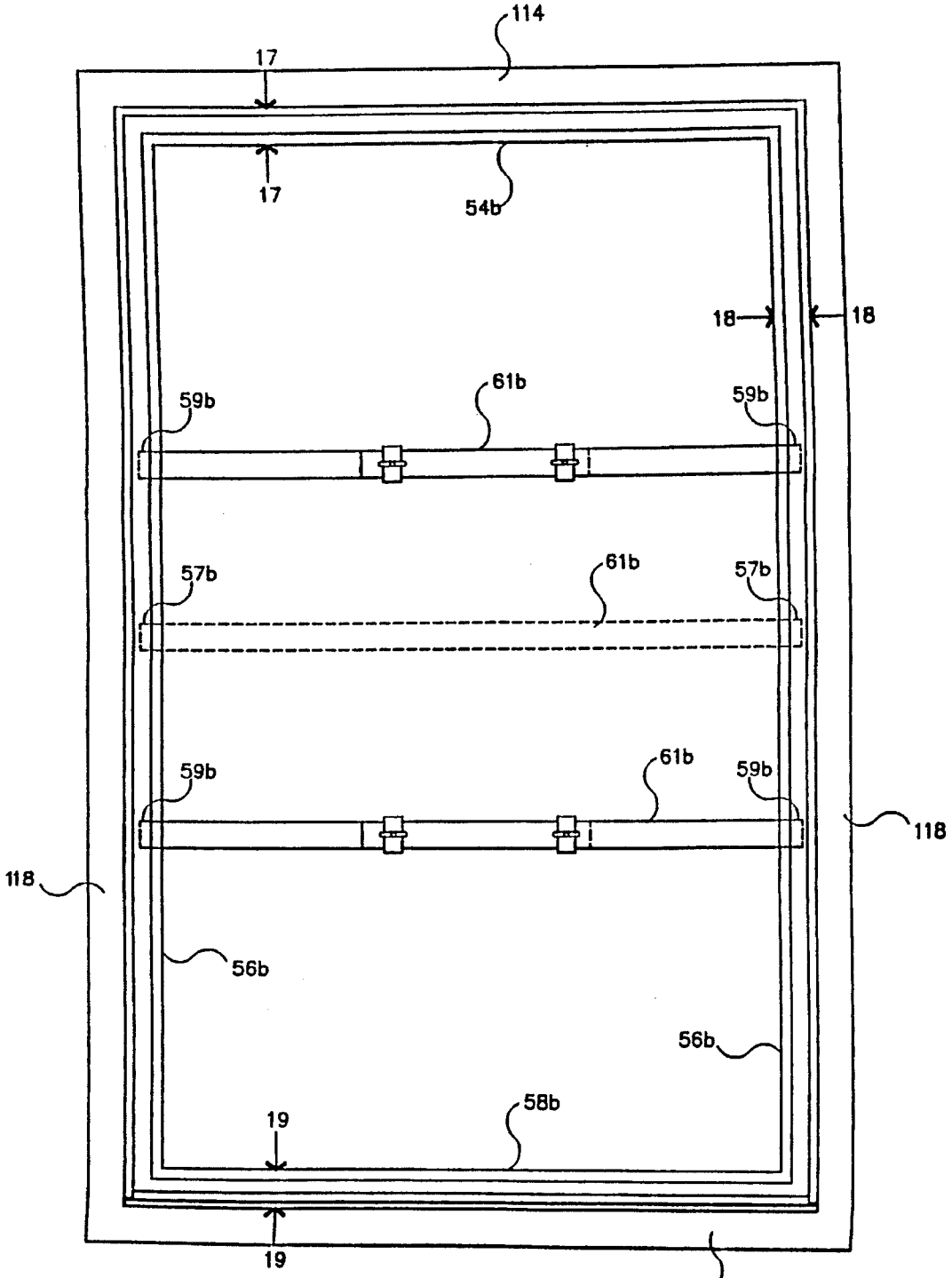
FIG. 16 is an elevation view of a fourth embodiment according to the present invention.
Figure 18:
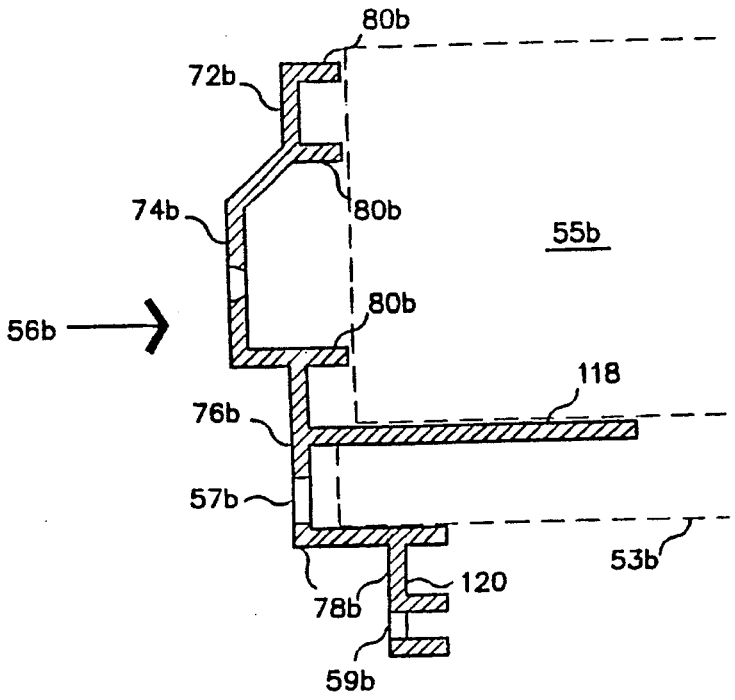
FIG. 18 is a cross-sectional view along lines 18—18 in FIG. 16.
Figure 17:
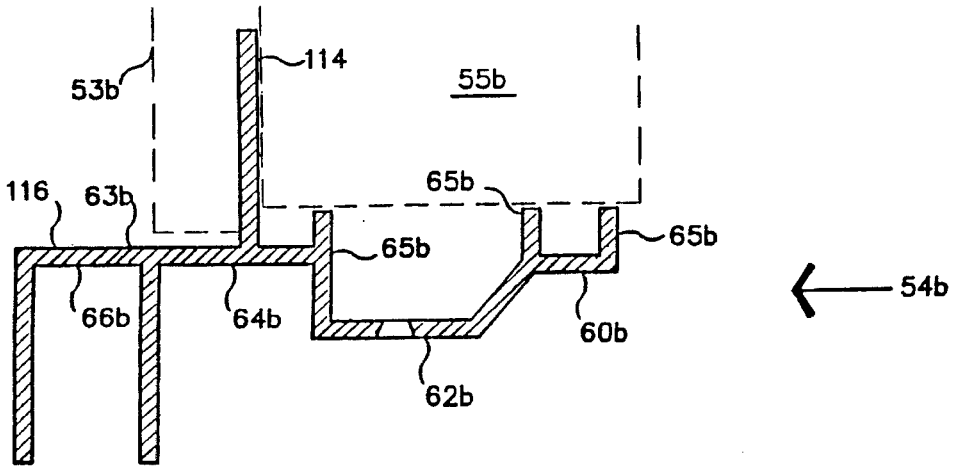
FIG. 17 is a cross-sectional view along line 17—17 in FIG. 16.
Figure 19:
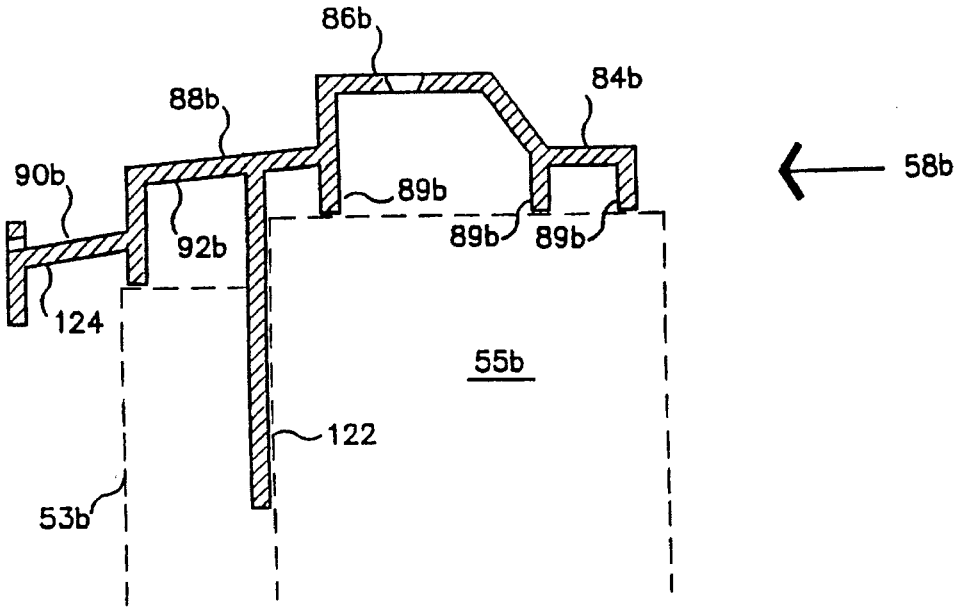
FIG. 19 is a cross-sectional view along line 19—19 in FIG. 16.

FIGS. 16–20 show a fourth embodiment according to the present invention designed for use with a 4" stud wall construction. As shown in FIGS. 17, 18 and 19, exterior surface plates 114, 118 and 122 are provided for engaging the unfinished exterior surface of a building wall 55*b* surrounding an aperture into which the frame is to be installed. As with the previously described embodiment, when the frame system is installed in this manner, support legs 65*b*, 80*b*, 89*b* adjacent to the edge of said interior spacers 60*b*, 72*b*, 84*b* will be positioned adjacent to an unfinished interior wall surface. An exterior siding material 53*b* is preferably applied over exterior surface plates 114, 118 and 122 such that exterior lips 63*b*, 83*b*, 92*b* are filled with said siding material as shown. If desired, a further finishing detail surface can be applied to build up the wall surface in the area surrounding the frame system such that the exterior siding material also fills detail lip 116, 120, 124 in FIGS. 17, 18 and 19, respectively. As shown in FIGS. 16 and 18, lock bar apertures 57*b* and 59*b* can be provided for receiving lock bars 61*b*.

Figure 20:
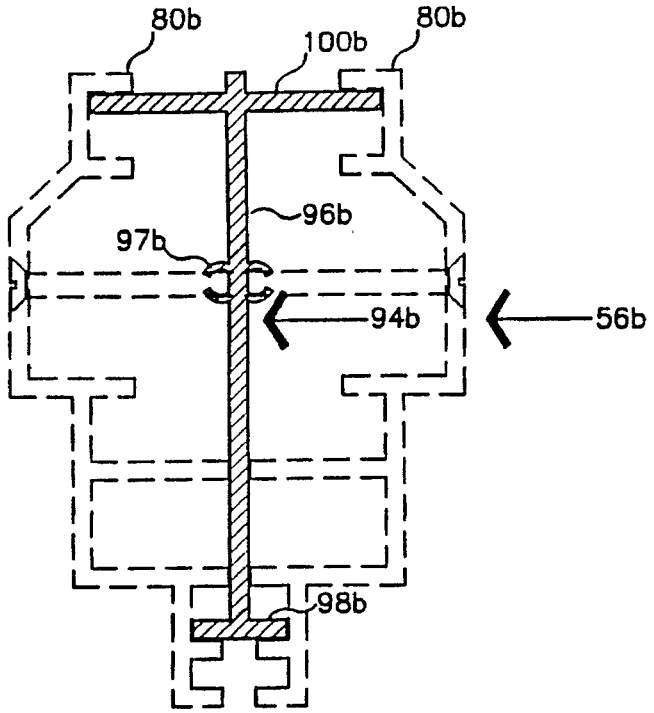
FIG. 20 is a cross-sectional view of a tee mullion for mounting a plurality of window frame systems as shown in FIG. 16, side by side.
Figure 21:
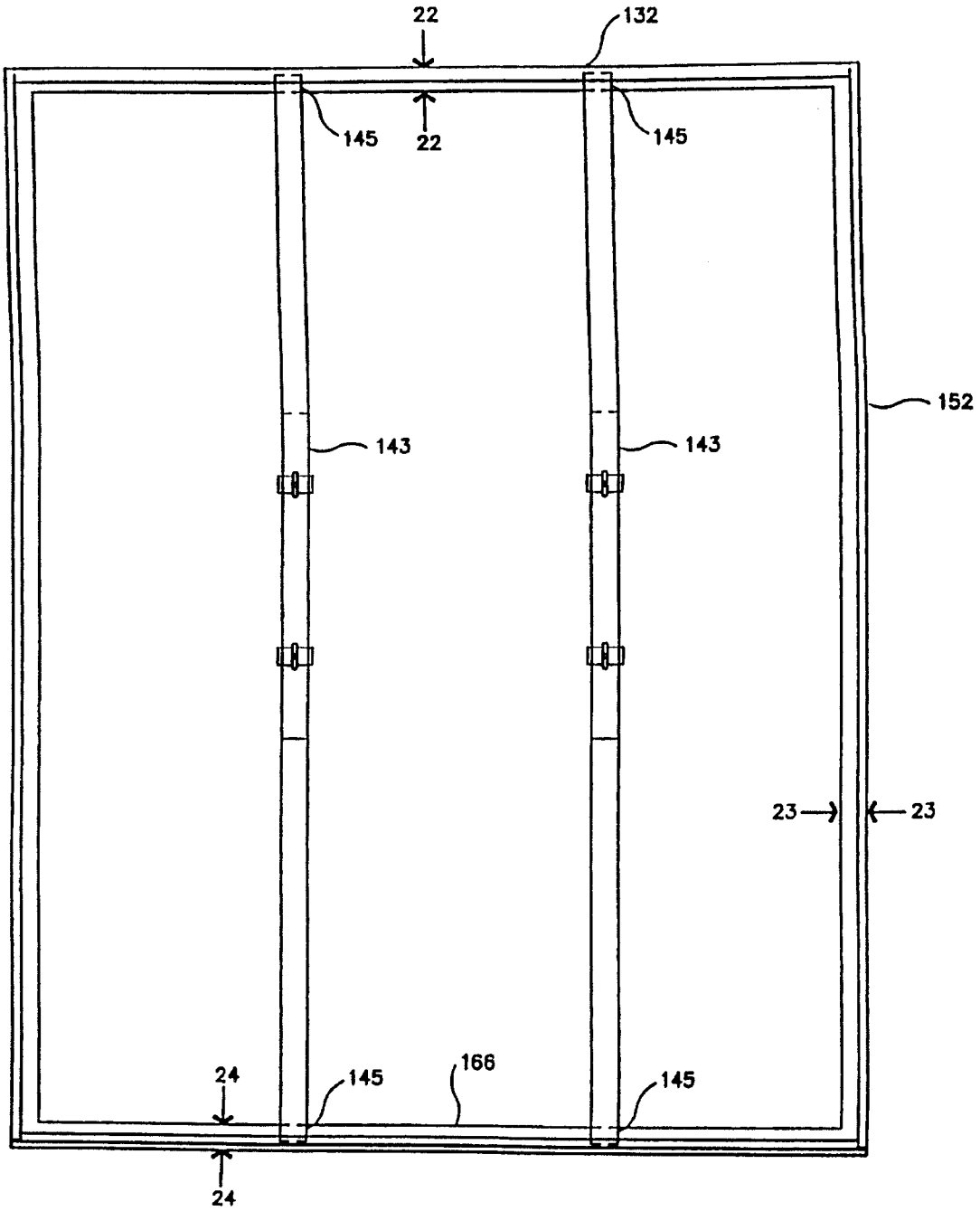
FIG. 21 is an elevation view of a fifth embodiment according to the present invention.

FIG. 20 shows a tee mullion 94*b* which performs the same function in essentially the same manner as described in the previous embodiments of the invention. The tee mullion is comprised of primary member 96*b*, screw receptacles 97*b*, main cross member 98*b*, and secondary cross member 100*b*.

Figure 23:
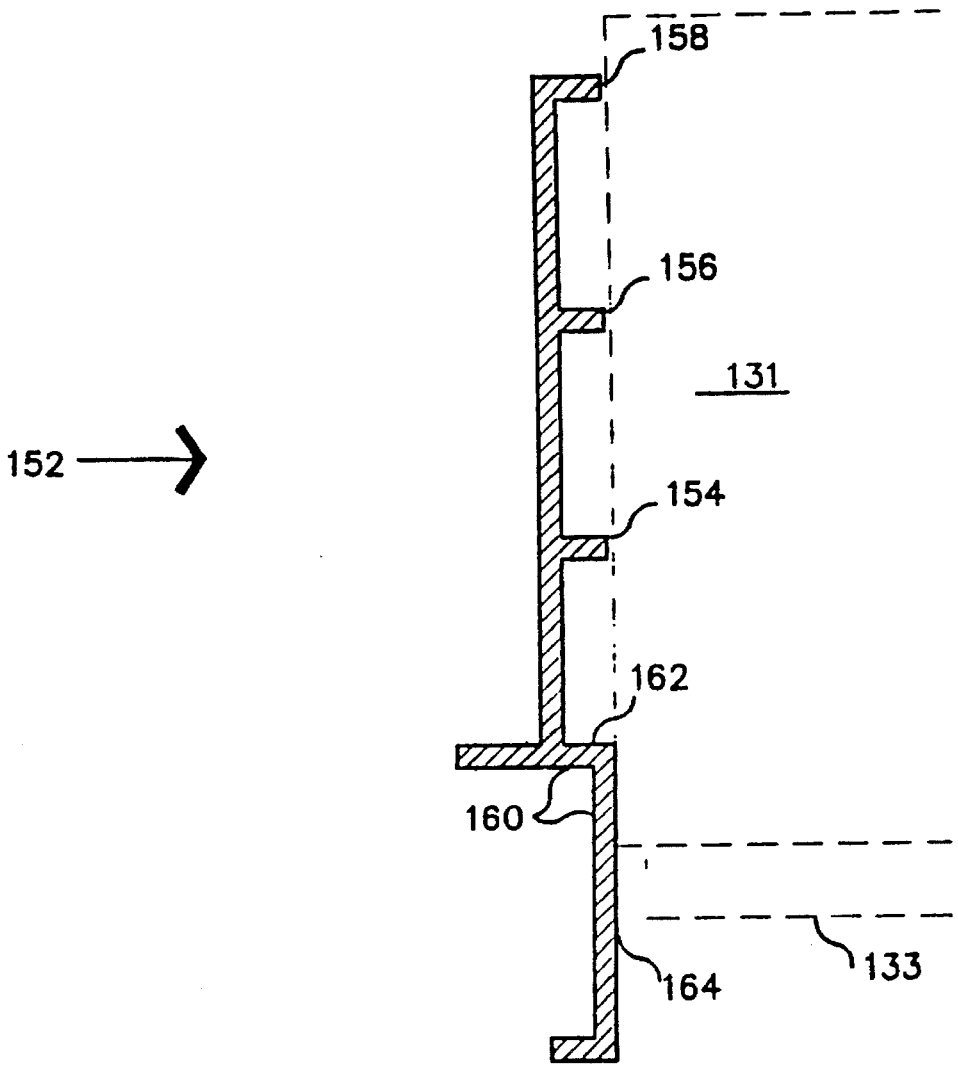
FIG. 23 is a cross-sectional view along lines 23—23 in FIG. 21.
Figure 22:
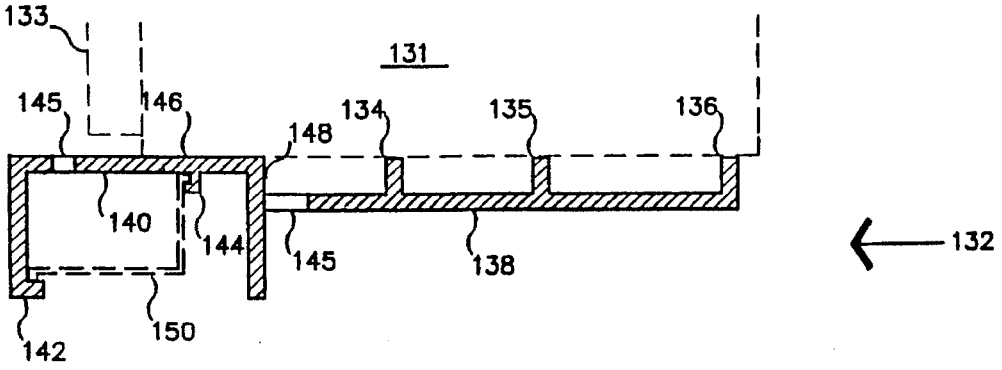
FIG. 22 is a cross-sectional view along line 22—22 in FIG. 21.
Figure 24:
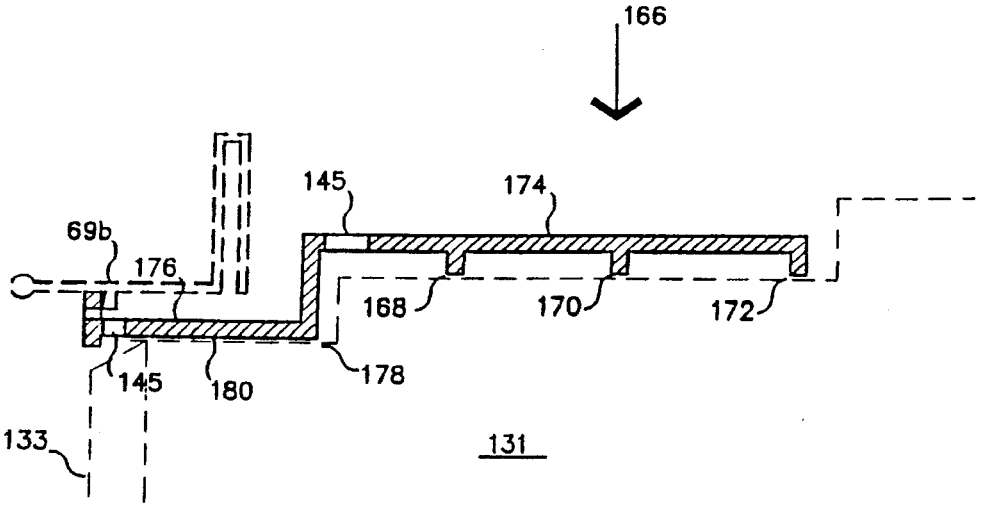
FIG. 24 is a cross-sectional view along lines 24—24 in FIG. 21.

FIGS. 21–24 are a fifth embodiment of a frame system according to the present invention. Significantly however, the embodiment of FIGS. 21–24 is designed for use with a sliding glass door unit. The head 132, jamb 152 and sill 166 shown in FIGS. 22–24 represent one possible configuration for a frame system. It should be noted, however, that the invention is not so limited, and other configurations are possible so long as they include an integrated door mounting surface and shutter support structure.

FIG. 22 is a cross-sectional view of a profiled head 132 which can be installed in a building aperture wherein a sliding glass door unit is to be installed. Profiled head 132 preferably traverses an upper portion of the building aperture such that support nubs 134, 135 and 136 engage a portion of the aperture surface traversing the distance between the interior and exterior sides of the building wall 131. Mounting surface 138 is preferably formed to provide a suitable mounting location for an upper portion of a sliding glass door unit. As with the previously described embodiments in FIGS. 1–20, a head guide channel 140 is provided for receiving a storm shutter.

Head locking tabs 142 and 144 are formed in profiled head 132 for receiving a spring clip 150. Spring clip 150 can be inserted in head lock tabs 142 and 144 to act as a spacer in the event that a storm shutter to be installed is of insufficient thickness to fill the entire channel 140. In a preferred embodiment, lock bar apertures 145 can be formed in guide channel 140 and mounting surface 138.

FIG. 23, is a cross-sectional view of a profiled jamb 152 according to the present embodiment of the invention. Similar to the profiled head 132, profiled jamb 152 includes support hubs 154, 156 and 158 for engaging a vertical surface of a doorway aperture traversing the distance between the interior and exterior surfaces of a building wall 131. Mounting surface is provided for mounting a sliding glass door unit. L-shaped mounting brace 160 is provided for receiving a storm shutter as described in the previous embodiments. Finally, an exterior surface plate 162 and an exterior lip surface 164 are also included in the profiled jamb 152. In an alternative embodiment, lock bar apertures may also be formed in profiled jamb 152.

FIG. 24 shows a cross-sectional view of a profiled sill 166 for use in the present frame system for a sliding glass doorway aperture. The sill 166 has a profiled configuration similar to jamb 152. Sill 166 includes a mounting surface 174, support hubs 168, 170 and 172, a mounting channel 176 and an exterior surface plate 178. An exterior lip surface 180 is also provided. Finally, lock bar apertures 145 may be formed in said mounting channel and said mounting surface to receive adjustable length lock bars 145.

As with the previously described embodiments, the profiled head 132, profiled jamb 152 and profiled sill 162 are preferably mitred at each end and joined together to form a substantially rectangular sliding glass door frame system. The frame system is preferably installed in a building aperture for a sliding glass door Such that exterior surface plates 162 and 178 engage a notched portion of a building wall 131 adjacent to and surrounding the doorway aperture. When mounted in this position, the support nubs 136, 158, 172 will preferably be positioned adjacent to or slightly offset from the interior surface of wall 131.

As with the previous embodiments, screws, bolts or any other suitable fastener may be used to attach the frame system within the building aperture. The frame system is preferably mounted to the portion of a building wall 131 traversing the distance between the exterior and interior surfaces of the building wall 131 defining the aperture. Mounting holes are preferably provided in the sill, jamb and head to receive mounting bolts capable of engaging building wall 131.

As noted above, the frame system is preferably positioned such that the interior-most support nubs 136, 158 and 172 associated with the profiled head, jamb and sill, respectively are substantially aligned with or slightly offset from the plane defined by the interior surface of an unfinished building wall 131. When mounted in this position, exterior lip surface 146, 164 and 180 associated with the head, jamb and sill, respectively will protrude slightly beyond the exterior surface of the wall 131 in which the doorway aperture is formed. In a preferred embodiment, an exterior siding 133 can be applied to the exterior surface of the building wall 131 such that less than the entire width of each of the above-referenced lip surfaces 146, 164 and 180 will protrude beyond the plane of the finished exterior surface. Specifically, the finished exterior siding surface 133 should be slightly recessed behind the exterior-most edge of the frame system.

The sliding glass door frame system as shown in FIGS. 22–24 possesses advantages similar to those described with regard to the previously described window frame systems. Specifically, the frame system provides a superior strength mechanism for mounting storm shutters of a type not previously known. By integrally forming the storm shutter mounting system with the sliding door mounting system, it is possible to take advantage of the internal bracing provided by the independent frame of a sliding glass door unit. This, in turn, helps prevent the mounting system from being torn out of its mounting position by excessively high winds or impacts. Furthermore, a broader mounting surface is provided than would normally be possible for shutter mounting brackets alone. This feature results in greater stability as compared to previous shutter mounting systems.

Figure 25:
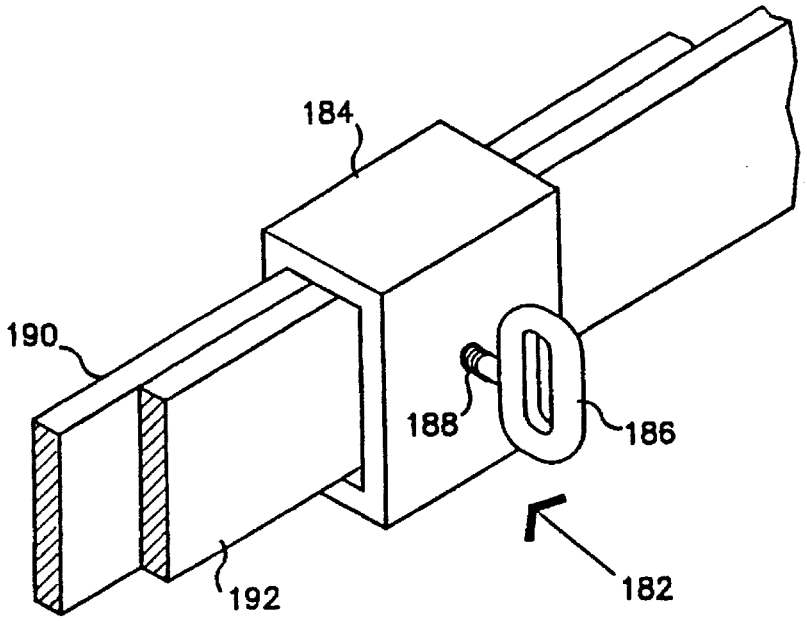
FIG. 25 is a perspective of a lock bar clamp of the type shown in FIGS. 1, 6, 11, 16 and 21.

FIG. 25 is a perspective view of a lock bar clamp 182 with lock bars 190, 192 in place. The lock bar clamp shown can be used in each of the above-described embodiments where an adjustable length lock bar is needed. The lock bar clamp 182 is comprised of a U-shaped bracket 184 with a threaded aperture 188. Threaded aperture 188 is provided for receiving a hand-screw 186 to clamp lock bars 190–192 in position with bracket 184. FIG. 25 discloses one possible method for providing adjustable length lock bars. However, numerous other mechanisms are possible and the invention is not limited to the embodiment shown in FIG. 25.

Figure 26:
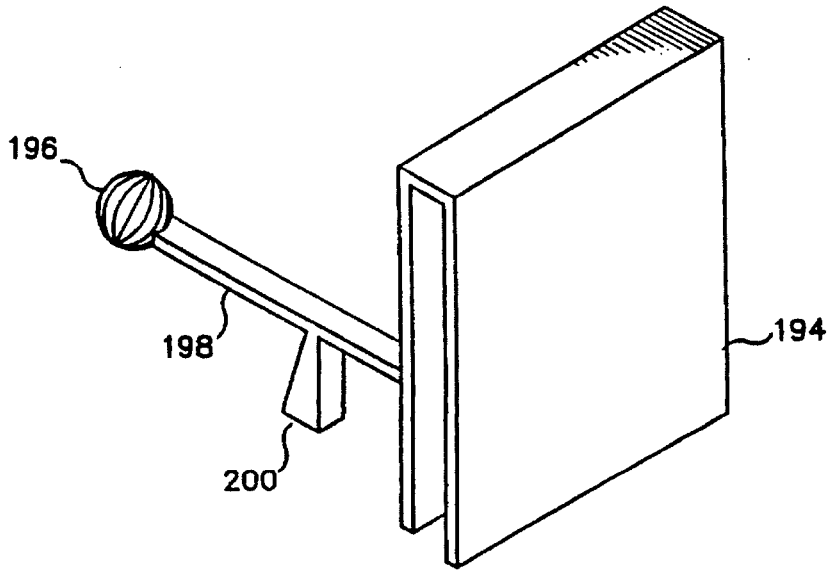
FIG. 26 is a perspective view of a spring tension aluminum clip of the type shown in FIGS. 9, 14 and 24.

FIG. 26 is a perspective view of a spring clip 69, **69*a*, 69*b* for use with the various embodiments of the present invention as shown in FIGS. 9, 14 and 24. As shown in FIG. 26, U-shaped support 194 is provided for resiliently engaging an exterior surface of an installed storm shutter. Catch 200 protrudes from beneath an extension rod 198 and is designed to engage a vertical flange portion of sill extension lip 92, 92*a*, 180 shown in FIGS. 9, 14 and 24. Finally, a finger grip 196 can be provided on an end portion of extension rod 198 to facilitate the spring clip being resiliently snapped into position in the various profiled sills as shown in FIGS. 9, 14 and 24**.

It will be appreciated that numerous embodiments and modifications of the above-described frame systems may be devised by those skilled in the art, and it is intended that the appended claims cover all such modifications and embodiments as followed in the true spirit and scope of the present invention.

I claim:

1. A portal frame structure for insert therein of a window frame and a shutter comprising:

(a) a pair of longitudinally displaced and aligned portal jamb frames, each of said portal jamb frames having a plurality of portal jamb frame sections formed each to the other in side by side relation including a first cross-sectionally formed U-shaped jamb frame section, a second cross-sectionally formed U-shaped jamb frame section for mounting of said window frame and having a second jamb frame section leg member in commonality with said first jamb frame section, a third cross-sectionally formed U-shaped jamb frame section having a third jamb frame section leg member, said third jamb frame section leg member in commonality with said second jamb frame section, a fourth cross-sectionally formed U-shaped jamb section, said fourth U-shaped jamb section having a fourth jamb frame section leg member in commonality with said third jamb section and a fifth jamb frame section leg member having a dimension length greater than said fourth jamb section leg member and mounted contiguous a building wall;

(b) a longitudinally extending portal head frame having a plurality of head frame sections formed each to the other in side by side relation including a first cross-sectionally formed U-shaped head frame section, a second cross-sectionally formed U-shaped head section for receipt of said window frame and having a second head frame section leg member in commonality with said first head section, a third cross-sectionally formed U-shaped head frame section having a third head frame section leg member in commonality with said second head frame section, a fourth cross-sectionally formed U-shaped head frame section having a fourth and a fifth head frame section leg member, said fourth head frame section leg member in commonality with said third head frame section, said fourth head frame section forming a head guide channel for insert of said shutter therein, and a sixth head frame section leg member extending in an opposing direction with respect said fourth and fifth head frame section leg members; and, (c) a longitudinally extending portal sill frame having a plurality of portal sill frame sections formed in side by side relation including a first cross-sectionally formed U-shaped sill frame section, a second cross-sectionally formed U-shaped sill frame section for receipt of said window frame and having a second sill frame section leg member in commonality with said first sill frame section, a third cross-sectionally formed U-shaped sill frame section having a third sill frame section leg member in commonality with said second sill frame section, a fourth cross-sectionally formed H-shaped sill frame section defining a fourth sill frame section leg member in commonality with said third sill frame section, a fifth sill frame section member joined to said fourth sill frame section leg member by a fourth sill base member forming a sill shutter channel for insert therein of said shutter and a sixth sill leg member coupled to said fourth sill section member and extending contiguous said building wall.

2. The portal frame structure as recited in claim 1 including a jamb leg member and a jamb lip member extending from said jamb fourth section.

3. The portal frame structure as recited in claim 2 where said jamb leg member and said jamb lip member at least partially capture a siding material member.

4. The portal frame structure as recited in claim 3 where said fifth jamb frame section leg member forms an exterior surface plate mounted between said building wall and said siding material member.

5. The portal frame structure as recited in claim 1 where said fourth cross-sectionally formed U-shaped head section includes said fifth head frame section leg member displaced from said fourth head frame section leg member and formed in one-piece formation to a head fourth section base member forming said guide channel.

6. The portal frame structure as recited in claim 5 including a first locking tab member formed on said head fourth section base member and extending internal said head guide channel.

7. The portal frame structure as recited in claim 6 including a second locking tab member formed on said fifth head frame section leg member and extending internal said head guide channel.

8. The portal frame structure as recited in claim 7 including means for resiliently adjusting a dimensional displacement distance of said head guide channel of said portal head frame.

9. The portal frame structure as recited in claim 8 where said means for resiliently adjusting includes a spring clip member having opposing ends in respective abutting relationship with said first and second locking tab members.

10. The portal frame structure as recited in claim 1 where said sill first, second, third and fourth sections are mounted adjacent a sidewall surface of a building wall.

11. The portal frame structure as recited in claim 1 where said fifth sill frame section leg member is secured to said fourth sill frame section leg member by a fourth sill base section member.

12. The portal frame structure as recited in claim 11 where said fourth and fifth sill frame section leg members extend above an upper surface of said sill base member for forming said sill shutter channel.

13. The portal frame structure as recited in claim 12 including means for resiliently capturing said shutter within said sill shutter channel.

14. The portal frame structure as recited in claim 13 where said means for resiliently capturing includes sill spring means for bearing against said fifth sill frame section leg member and said shutter on opposing ends thereof.

15. The portal frame structure as recited in claim 1 including:

(a) a third portal jamb frame having a plurality of portal jamb frame sections aligned with each of said portal jamb frame sections of one of said pair of said portal jamb frames for providing respective first, second, third and fourth jamb sections in aligned positional location each with respect to the other; and, (b) means for coupling said third portal jamb frame to one of said pair of portal jamb frames.

16. The portal frame structure as recited in claim 15 where said means for coupling includes a Tee-mullion member mounted between said third portal jamb frame and said one of said pair of said portal jamb frames.

* * * * *